US006146478A

United States Patent [19]

Balbach et al.

[11] Patent Number: 6,146,478

[45] Date of Patent: Nov. 14, 2000

[54] HEAT TREATMENT PROCESS FOR MATERIAL BODIES MADE OF A HIGH-TEMPERATURE-RESISTANT IRON-NICKEL SUPERALLOY, AND HEAT-TREATMENT MATERIAL BODY

[75] Inventors: Werner Balbach, Würenlingen; Gunnar Härkegård, Untersiggenthal, both of Switzerland; Reiner Redecker, Hohentengen, Germany

[73] Assignee: Asea Brown Boveri AG, Baden, Switzerland

[21] Appl. No.: 08/955,631

[22] Filed: Oct. 22, 1997

[30] Foreign Application Priority Data

Nov. 2, 1996 [DE] Germany ..... 196 45 186

[51] Int. Cl.[7] ..... C22F 1/16

[52] U.S. Cl. ..... 148/707; 148/607; 148/677

[58] Field of Search ..... 148/675, 676, 148/677, 607, 707

[56] References Cited

U.S. PATENT DOCUMENTS

| | | | |
|---|---|---|---|
| 4,128,419 | 12/1978 | Terekhov et al. . | |
| 4,798,632 | 1/1989 | Yonezawa et al. | 148/410 |
| 5,059,257 | 10/1991 | Wanner et al. | 148/410 |
| 5,360,496 | 11/1994 | Kuhlman et al. | 148/677 |
| 5,374,323 | 12/1994 | Kuhlman et al. | 148/677 |
| 5,415,712 | 5/1995 | Thambo | 148/707 |
| 5,429,690 | 7/1995 | Heubner et al. | 148/677 |
| 5,846,353 | 12/1998 | Nazmy et al. | 148/707 |

FOREIGN PATENT DOCUMENTS

| | | |
|---|---|---|
| 1133566 | 7/1962 | Germany . |
| 1233609 | 2/1967 | Germany . |

OTHER PUBLICATIONS

"Heat Treatment of 706 Alloy for Optimum 1200°F Stress–Rupture Properties", Moll, et al., Metallurgical Transactions, vol. 2, Aug. 1971, p. 2153–2160.

*Primary Examiner*—John Sheehan

*Attorney, Agent, or Firm*—Burns, Doane, Swecker & Mathis, L.L.P.

[57] ABSTRACT

A heat treatment process for material bodies made of a high-temperature-resistant iron-nickel superalloy of the type IN 706 comprises the following steps: solution annealing at approximately 965 to 995° C. for 5 to 20 hours, stabilization annealing at approximately 775 to 835° C. for 5 to 100 hours, and precipitation hardening at 715 to 745° C. for 10 to 50 hours and at 595 to 625° C. for 10 to 50 hours. A heat-treated material body of this kind, made of a high-temperature-resistant iron-nickel superalloy of the type IN 706 exhibits a crack growth rate of less than 0.05 mm/h and/or exhibits a minimum elongation of 2.5% without cracks at a constant strain rate of 0.05%/h and a temperature of 600° C.

15 Claims, 2 Drawing Sheets

HEAT TREATMENT PROCESS FOR MATERIAL BODIES MADE OF A HIGH-TEMPERATURE-RESISTANT IRON-NICKEL SUPERALLOY, AND HEAT-TREATMENT MATERIAL BODY

BACKGROUND OF THE INVENTION

1. Field of the Invention

The invention relates to a heat treatment process for material bodies made of an iron-nickel superalloy, of the type IN 706. The invention also relates to heat-treated material bodies made of a high-temperature-resistant iron-nickel superalloy of the type IN 706, in particular for use in rotors of thermal machines.

2. Discussion of Background

The invention takes as its reference a prior art as described, for example, by J. H. Moll et al. "Heat Treatment of 706 Alloy for Optimum 1200° F. Stress-Rupture Properties" Met. Trans. 1971, vol. 2, pp. 2153–2160.

It is known from this prior art that the properties of the alloy IN 706 which are critical for its use as a material for components which are subject to high temperatures, such as for example the heat resistance and the ductility, are determined by heat treatment processes which are carried out in a suitable manner. Depending on the microstructure of the starting body forged from the alloy IN 706, typical heat treatment processes comprise, for example, the following process steps: Solution annealing of the starting body at a temperature of 980° C. for a period of 1 h, cooling of the solution-annealed starting body with air, precipitation hardening at a temperature of 840° C. for a period of 3 h, cooling with air, precipitation hardening at a temperature of 720° C. for a period of 8 h, cooling at a cooling rate of about 55° C./h to 620° C., precipitation hardening at a temperature of 620° C. for a period of 8 h, and cooling with air, or, for example: Solution annealing of the starting body at temperatures of around 900° C. for 1 h, cooling with air, precipitation hardening at 720° C. for a period of 8 h, cooling at a cooling rate of about 55° C./h to 620° C., precipitation hardening at 620° C. for 8 h, and cooling with air.

SUMMARY OF THE INVENTION

Accordingly, one object of the invention is to provide a novel heat treatment process of the type specified at the outset, by means of which it is simple to create a material body made of the alloy of type IN 706 which has a sufficiently high heat resistance, high ductility and a crack growth rate which is as slow as possible.

According to the invention, this is achieved by by a heat treatment process wherein the superalloy is subjected to solution annealing, stabilization annealing and two precipitation hardening treatments.

The core features of the invention are therefore solution annealing at approximately 965 to 995° C. for 5 to 20 hours, stabilization annealing at approximately 775 to 835° C. for 5 to 100 hours, and precipitation hardening at 715 to 745° C. for 10 to 50 hours and at 595 to 625° C. for 10 to 50 hours.

The process according to the invention is distinguished primarily by the fact that it is simple to carry out and that it avoids the formation of precipitations which have an embrittling action. In addition, an extremely low crack growth rate is achieved in the material bodies heat-treated in this manner. If strain is applied to the material bodies at a constant rate of 0.05%/h at a temperature of 600° C., total elongations of at least 2.5% are achieved without cracks. Furthermore, material bodies produced by the process according to the invention are distinguished by the fact that no cracks are formed by grain boundary oxidation if stress is applied to the usual chemical composition.

A material body produced by the process according to the invention is therefore excellently suited for use as starting material in the manufacture of a rotor, which is subject to high thermal and mechanical loads, in a large gas turbine.

Preferred exemplary embodiments of the invention and the further advantages which can be achieved therewith are explained in more detail below.

Further advantageous configurations of the invention emerge furthermore from the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show material bodies made of IN 706, and wherein.

DESCRIPTION OF THE PREFERRED EMBODIMENTS

Figure 1:
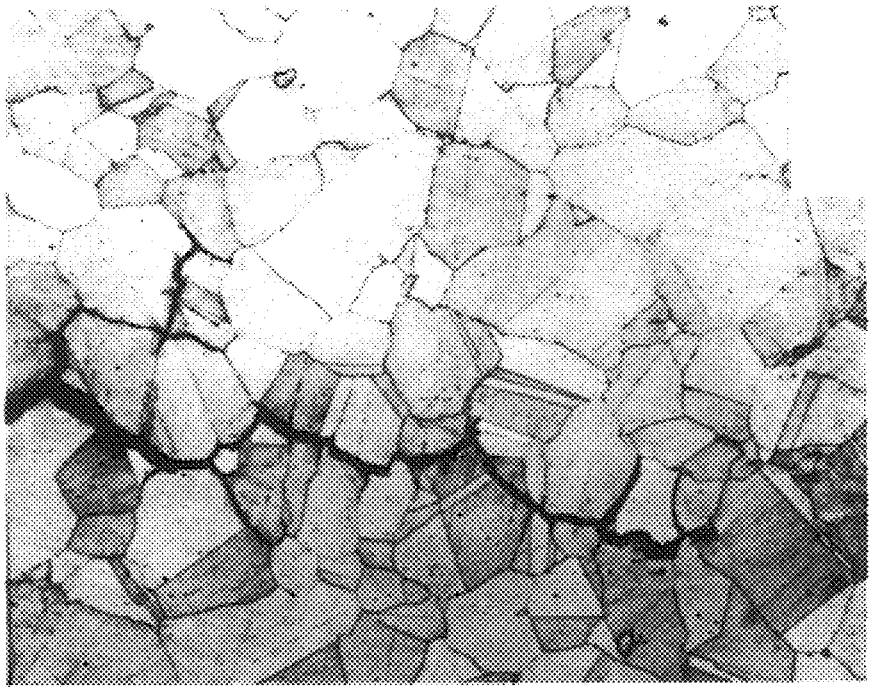
FIG. 1 shows a crack in a material body without stabilization annealing resulting from stress accelerated grain boundary oxidation, enlarged 100 times.

A number of commercially available, forged starting bodies made of the alloy IN 706 were each introduced into a furnace and subjected to different heat treatment processes E, F, G and H. The starting bodies each had an identical microstructure and the same chemical composition, it being possible for the composition of the starting bodies to vary within the limit ranges specified below:

| | |
|---|---|
| max. 0.025 | carbon |
| max. 0.12 | silicon |
| max. 0.35 | manganese |
| max. 0.002 | sulfur |
| max. 0.015 | phosphorus |
| 15 to 18 | chromium |
| 40 to 43 | nickel |
| 0.1 to 0.3 | aluminum |
| max. 0.1 | tantalum |
| 1.5 to 1.8 | titanium |
| max. 0.30 | copper |
| 2.8 to 3.2 | niobium |
| max. 0.01 | boron |
| remainder | iron |

The heat treatment processes E, F, G and H of the starting bodies are shown in the following table.

| Heat treatment process | E | F | G | H |
|---|---|---|---|---|
| 5–15 h solution annealing in a furnace at 980 ± 15° C. | X | X | X | X |
| Cooling in air | | X | X | X |
| Cooling with oil or the like to RT | X | | | |
| 10–100 h holding in the furnace at 820 ± 15° C. | X | | | |
| 10 h holding in the furnace at 845° C. | | | X | |
| 10 h holding in the furnace at 780° C. | | X | | |
| Cooling in air to RT | X | X | X | |
| 10–50 h holding in the furnace at 730 ± 15° C. | X | X | X | X |
| Cooling in air to RT | X | X | X | X |
| 5–20 h holding in the furnace at 610 ± 15° C. | X | X | X | X |
| Cooling in air to RT | X | X | X | X |
| Material body | E' | F' | G' | H' |

A further heat treatment step with a stabilizing action, in which the solution-annealed starting body is held at different temperatures, was included prior to the first precipitation-hardening step.

The heat treatment process H here serves only as a comparison, and in this process the stabilization annealing was omitted.

In this context, cooling of the starting bodies E, F and G to RT means that the bodies were cooled to room temperature, or at least to below 300° C. Depending on the sizes of the starting bodies, the cooling rates in air are about 0.5° C./min to 10° C./min, and with oil they are 2° C./min to 20° C./min, in the temperature range above 700° C.

The holding times may fluctuate within the ranges stated above, the holding times and cooling rates being affected essentially by the size of the workpieces to be treated. This means that the holding time has to be increased for larger workpieces, in order that the workpieces can be soaked completely. It is possible to omit the step of cooling to RT between the two hardening annealing steps at 730 and 610° C.

The material bodies E', F', G' and H' resulting from the heat treatment processes were used to produce specimens for the tests shown below, the material characteristics of which are summarized in the following table.

| Material body | E' | F' | G' | H' |
|---|---|---|---|---|
| Tensile strength at 600° C. [MPa] | 970 | 1005 | 1000 | 1070 |
| Elongation at break at 600° C. [%] | 20.5 | 16 | 14 | 14.5 |
| Notched-impact energy at RT [J] | 39 | 42 | 19 | 70 |
| Crack propagation rate da/dt at 600° C. and a stress intensity factor K = 40 Mpa m [mm/h] | 0.001 | | | >1 |

It is clear that for material body E' although the tensile strength falls slightly at 600° C., the elongation at break increases considerably at 600° C. Moreover, the material body E' exhibits a very low crack propagation rate of less than 0.05 mm/h, which represents an unusually good level for this class of material and makes this material particularly suitable for use in rotors of thermal machines.

The material bodies were furthermore subjected to a CSR test (Constant Strain Rate). In this test, the material body is extended at a temperature of 600° C. and a constant strain rate of 0.05%/h. The condition that it be possible to apply an elongation of at least 2.5% to the material body without the appearance of cracks was fulfilled by the material bodies E' and F'.

Figure 2:
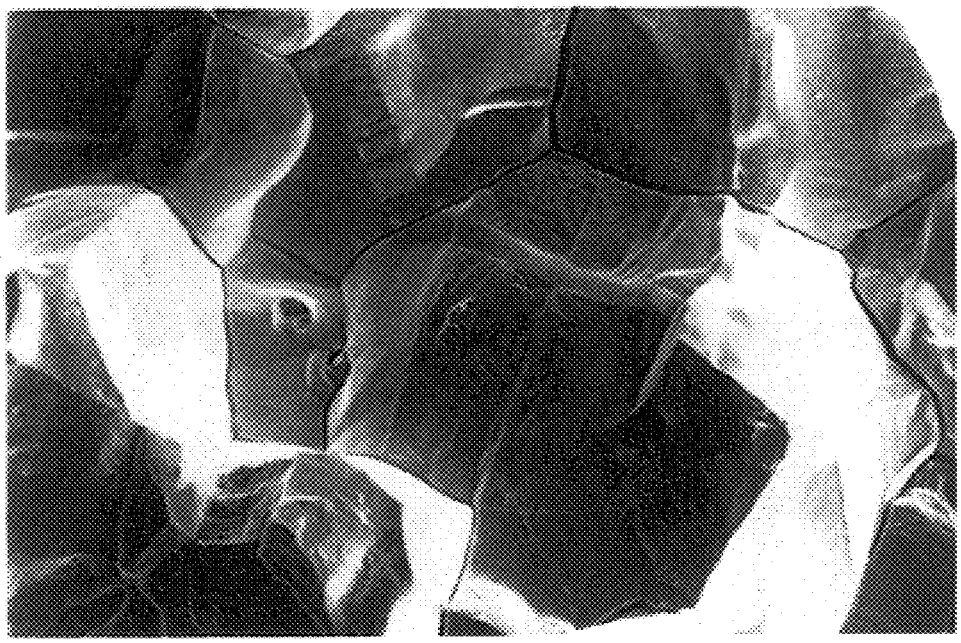
FIG. 2 shows a scanning electron microscope picture of a surface of the crack from FIG. 1, enlarged 300 times.

FIGS. 1 and 2 show a fracture face image of a material body without stabilization annealing, for example H', in which SAGBO-cracks (Stress Accelerated Grain Boundary Oxidation) can be clearly seen, these cracks having appeared when stress was applied to the material body.

Figure 3:
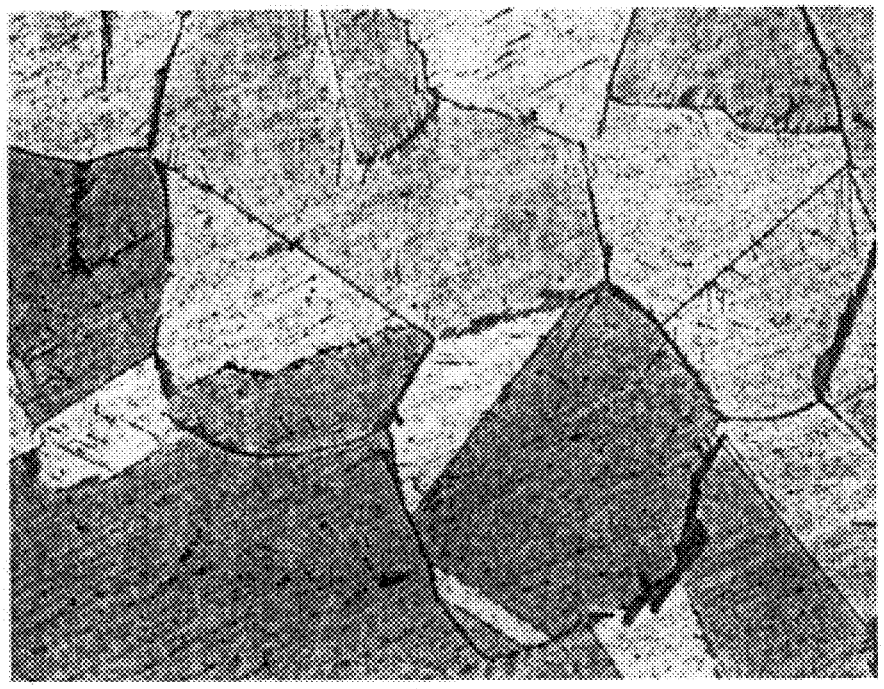
FIG. 3 shows a microsection of the structure of a material body which has been subjected to stabilization annealing at 845° C. for 5 hours, enlarged 500 times.

As shown in FIG. 3, if stabilization annealing is carried out at 845° C. for 5 h, corresponding to material body G', an undesirable acicular phase is formed. With longer holding times or at higher temperatures, this acicular phase is even more markedly present. The notched-impact energy is reduced considerably by this acicular phase.

Figure 4:
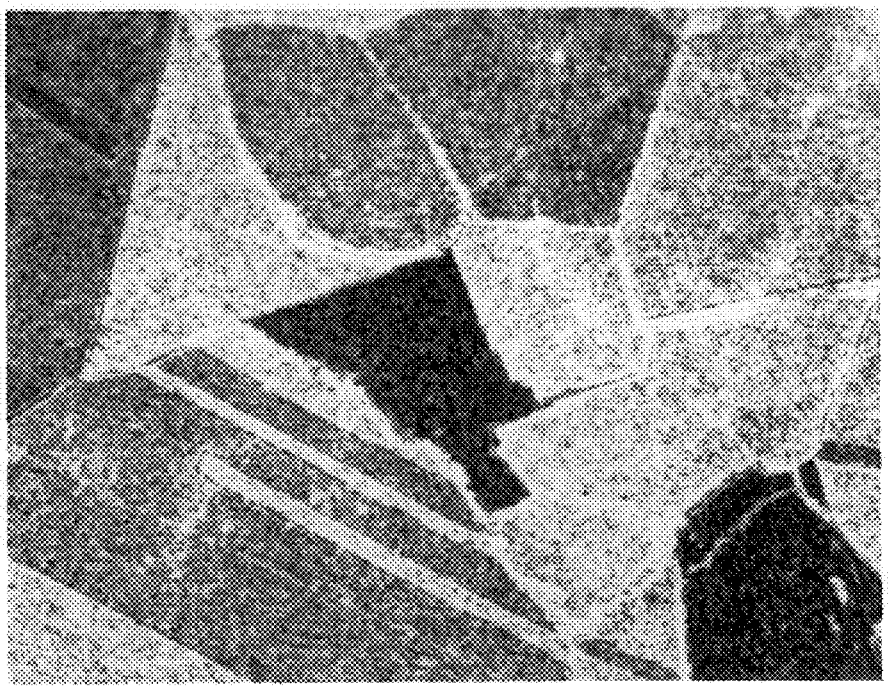
FIG. 4 shows a microsection of a material body which has been subjected to stabilization annealing at 820° C. for 10 hours, enlarged 500 times.

As FIG. 4 shows, if stabilization annealing is carried out at 820° C. for 10 h, corresponding to material body E', an undesirable acicular phase is no longer formed, not even if the holding time is increased and the temperature is reduced, e.g. stabilization annealing at 780° C./100 h.

Starting bodies whose composition fluctuates within the limit ranges indicated above and which were subjected, following to the solution annealing treatment and prior to the precipitation hardening, to a stabilization annealing at a temperature between 775 and 835° C., in particular at 820° C., for 5 to 100 hours, preferably 10 to 20 hours, thus exhibit an extremely low crack growth rate, a minimum elongation without cracks of 2.5% in the CSR test, no SAGBO-cracks and the following properties at room temperature:

| Characteristic | Unit | |
|---|---|---|
| Tensile strength $R_m$ | $N/mm^2$ | 1000 |
| Yield strength $R_{eH}$ or 0.2% elongation limit $R_{p0.2}$ | $N/mm^2$ | 750 |
| Elongation $A_5$ | % | 10 |
| Reduction in cross section Z | % | 12 |
| Impact energy absorbed | J | 30 |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A heat treatment process for material bodies made of a high-temperature-resistant iron-nickel superalloy including, in weight %, up to 0.025% C, up to 0.12% Si, up to 0.35% Mn, up to 0.002% S, up to 0.015% P, 15 to 18% Cr, 40 to 43% Ni, 0.1 to 0.3% Al, up to 0.1% Ta, 1.5 to 1.8% Ti, up to 0.30% Cu, 2.8 to 3.2% Nb, up to 0.01% B, balance Fe, which comprises the following steps:

solution annealing at approximately 965 to 995° C. for 5 to 20 hours, cooling to 300° C. or below, stabilization annealing at approximately 775 to 835° C. for 5 to 100 hours, cooling to 300° C. or below, and precipitation hardening at 715 to 745° C. for 10 to 50 hours and at 595 to 625° C. for 10 to 50 hours.

2. The heat treatment process as claimed in claim 1, wherein the stabilization annealing is carried out for from 10 to 20 hours.

3. The heat treatment process as claimed in claim 1, wherein the stabilization annealing is carried out at approximately 820° C.

4. The heat treatment process as claimed in claim 1, wherein the material bodies are cooled with oil between the solution annealing and the stabilization annealing.

5. The heat treatment process as claimed in claim 1, wherein the material bodies are cooled in air between the stabilization annealing and the precipitation hardening.

6. The heat treatment process as claimed in claim 1, wherein the material bodies are cooled to 300° C. or below between the precipitation hardening at 715 to 745° C. and the precipitation hardening at 595 to 625° C.

7. The heat treatment process as claimed in claim 1, wherein after the heat treatment the superalloy exhibits total elongation of at least 2.5% without cracking under constant strain of 0.05% per hour at 600° C.

8. The heat treatment process as claimed in claim 1, wherein the superalloy comprises a turbine rotor.

9. The heat treatment process as claimed in claim 1, wherein after the heat treatment the superalloy is free of an acicular phase.

10. The heat treatment process as claimed in claim 1, wherein after the solution annealing the superalloy is cooled to room temperature at a rate of 0.5 to 10° C./min.

11. A heat treatment process for a material body made of a high-temperature-resistant iron-nickel superalloy including, in weight %, up to 0.025% C, up to 0.12% Si, up to 0.35% Mn, up to 0.002% S, up to 0.015% P, 15 to 18% Cr, 40 to 43% Ni, 0.1 to 0.3% Al, up to 0.1% Ta, 1.5 to 1.8% Ti, up to 0.30% Cu, 2.8 to 3.2% Nb, up to 0.01% B, balance Fe, the process comprising the following steps:

introducing the body into a furnace;

heating the body in the furnace to a solution annealing temperature of approximately 965 to 995° C. and maintaining the body at 965 to 995° C. for 5 to 20 hours;

cooling the body to a temperature of 300° C. or below;

introducing the body into a furnace;

heating the body to a stabilization annealing temperature of approximately 775 to 835° C. and maintaining the body at 775 to 835° C. for 5 to 100 hours;

cooling the body to 300° C. or below;

introducing the body into a furnace;

heating the body to a precipitation hardening temperature of 715 to 745° C. and maintaining the body at 715 to 745° C. for 10 to 50 hours;

cooling the body to a precipitation hardening temperature of 595 to 625° C. and maintaining the body at 595 to 625° C. for 10 to 50 hours.

12. The heat treatment process as claimed in claim 11, wherein after the heat treatment the superalloy exhibits total elongation of at least 2.5% without cracking under constant strain of 0.05% per hour at 600° C.

13. The heat treatment process as claimed in claim 11, wherein the superalloy comprises a turbine rotor.

14. The heat treatment process as claimed in claim 11, wherein after the heat treatment the superalloy is free of an acicular phase.

15. The heat treatment process as claimed in claim 11, wherein after the solution annealing the superalloy is cooled in air to room temperature at a rate of 0.5 to 10° C./min.

* * * * *